US009610585B2

(12) United States Patent
Zhou et al.

(10) Patent No.: US 9,610,585 B2
(45) Date of Patent: Apr. 4, 2017

(54) SHREDDER SUPPORT FRAME

(71) Applicants: Licheng Zhou, Changzhou (CN); Jian Chen, Changzhou (CN); Qing Li, Changzhou (CN); Haiting Chen, Suzhou (CN); Ziqiang Ding, Changzhou (CN); Jianbo Qi, Changzhou (CN)

(72) Inventors: Licheng Zhou, Changzhou (CN); Jian Chen, Changzhou (CN); Qing Li, Changzhou (CN); Haiting Chen, Suzhou (CN); Ziqiang Ding, Changzhou (CN); Jianbo Qi, Changzhou (CN)

(73) Assignee: New United Office Equipments Co., Ltd, Changzhou (CN)

( * ) Notice: Subject to any disclaimer, the term of this patent is extended or adjusted under 35 U.S.C. 154(b) by 629 days.

(21) Appl. No.: 13/890,061

(22) Filed: May 8, 2013

(65) Prior Publication Data

US 2014/0332613 A1 Nov. 13, 2014

(51) Int. Cl.

| | |
|---|---|
| ***B02C 18/00*** | (2006.01) |
| ***B02C 18/14*** | (2006.01) |
| *B02C 18/16* | (2006.01) |

(52) U.S. Cl.

CPC ..... *B02C 18/0007* (2013.01); *B02C 18/142* (2013.01); *B02C 2018/0046* (2013.01); *B02C 2018/0069* (2013.01); *B02C 2018/162* (2013.01)

(58) Field of Classification Search

CPC .... B02C 2018/0069; B02C 2018/0046; B02C 18/16; B02C 2018/0015; B02C 18/0007; B02C 2018/162; B02C 18/142

USPC ..... 241/100, 236

See application file for complete search history.

(56) References Cited

U.S. PATENT DOCUMENTS

| | | | | |
|---|---|---|---|---|
| 4,997,134 | A * | 3/1991 | MacGregor | B02C 18/0007 241/236 |
| 5,961,059 | A * | 10/1999 | Kroger | B02C 18/0007 241/236 |
| 2002/0195510 | A1* | 12/2002 | Lin | B02C 18/0007 241/236 |
| 2008/0197221 | A1* | 8/2008 | Hartnett | B02C 18/182 241/91 |
| 2008/0217450 | A1* | 9/2008 | Jones | B02C 18/0007 241/169 |

(Continued)

*Primary Examiner* — Faye Francis
*Assistant Examiner* — Onekki Jolly
(74) *Attorney, Agent, or Firm* — Lowe Graham Jones PLLC

(57) ABSTRACT

A shredder mechanism is disclosed herein including first and second shredder portions positioned opposite one another and defining a slot therebetween. The first and second shredder portions each include a longitudinal support having more upper fins and a plurality of lower fins. each defining a shaft receptacle. A shaft is positioned between the upper and lower fins positioned within the shaft receptacles. A plurality of cutting blades are mounted to the shaft and extend into the slot. Each of the one or more upper fins and the plurality of lower fins extend among the plurality of cutting blades. The longitudinal support includes upper and lower support portions having the one or more upper fins secured to the upper support portion and the plurality of lower fins secured to the lower support portion.

5 Claims, 5 Drawing Sheets

(56) References Cited

U.S. PATENT DOCUMENTS

| | | | | |
|---|---|---|---|---|
| 2010/0176231 | A1* | 7/2010 | Jiang | B02C 18/0007 241/101.2 |
| 2011/0089277 | A1* | 4/2011 | Chao | B02C 18/0007 241/169.1 |
| 2011/0253819 | A1* | 10/2011 | Aries | B02C 18/0007 241/100 |

* cited by examiner

SHREDDER SUPPORT FRAME

FIELD OF THE INVENTION

The invention relates generally to a document shredder and more particularly to a shredder portion of the document shredder.

BACKGROUND OF THE INVENTION

Document shredders are used to shred confidential or private documents to prevent unwanted viewing of the document by others. Document shredders of one type of design have two rotating motor-driven shredder shafts with documents to be shredded being fed between the two rotating motor-driven shredder shafts. The shredders of this type of design may be constructed of a plurality of discs mounted on the two rotating motor-driven shafts. The shaft-mounted rotating discs have cutters formed on the discs to shred documents. When documents to be shredded are fed between these two rotating shafts, impact and bending forces may be experienced by components of the shredders and particularly the two motor-driven shafts. These impact and bending forces along with increased torque in the rotating shafts due to shredding may lead to deformation of the shafts, particularly in a horizontal direction, i.e., a direction generally perpendicular to the feed direction (a direction perpendicular to the a plane defined by the axes of rotation of the two rotating shafts) of the documents to be shredded. Since this deformation is undesirable and may lead to failure of shredder components or incomplete shredding, stronger shredder components may be required in order to lessen the possibility of failure of shredder components. Stronger shredder components, such as larger diameter rotating shafts may increase the cost and weight of the document shredder. These impact and bending forces may also potentially reduce the service life of shredder components. Additionally the above undesirable deformation may limit the rate and volume of documents to be shredded. Accordingly, a need exists in the art for a means to limit the above-described undesirable deformation of the shredders.

SUMMARY OF THE INVENTION

The present invention solves the above need in the art to reduce undesirable deformation of the shredders of this particular type of design of document shredders. This need is satisfied by use of a shredder mechanism including first and second shredder portions positioned opposite one another and defining a slot therebetween. The first and second shredder portions each include a longitudinal support. One or more upper fins are secured to the longitudinal support. At least one of the one or more upper fins is spaced inward from ends of the longitudinal support. The one or more upper fins further define one or more upper shaft receptacles. A plurality of lower fins are also secured to the longitudinal support and define a plurality of lower shaft receptacles. A shaft is positioned between the one or more upper shaft receptacles and the plurality of lower shaft receptacles. The shaft is therefore hindered from deflection by the one or more upper fins and the plurality of lower fins. A plurality of cutting blades are mounted to the shaft and extend into the slot. Each of the one or more upper fins and the plurality of lower fins extend among the plurality of cutting blades.

In some embodiments, the longitudinal support includes upper and lower support portions having the one or more upper fins secured to the upper support portion and the plurality of lower fins secured to the lower support portion. The one or more upper fins are may be monolithically formed with the upper support portion and the plurality of lower fins may be monolithically formed with the lower support portion. For example, the one or more upper fins and upper support portion may be part of a first die cast metal member (or molded plastic member) and the plurality of lower fins and the lower support portion may be part of a second die cast metal member (or molded plastic member).

In another aspect of the invention, the a number of the one or more upper fins is less than a number of the plurality of lower fins. For example, a number of the plurality of lower fins may be from two to four times greater than a number of the one or more upper fins.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
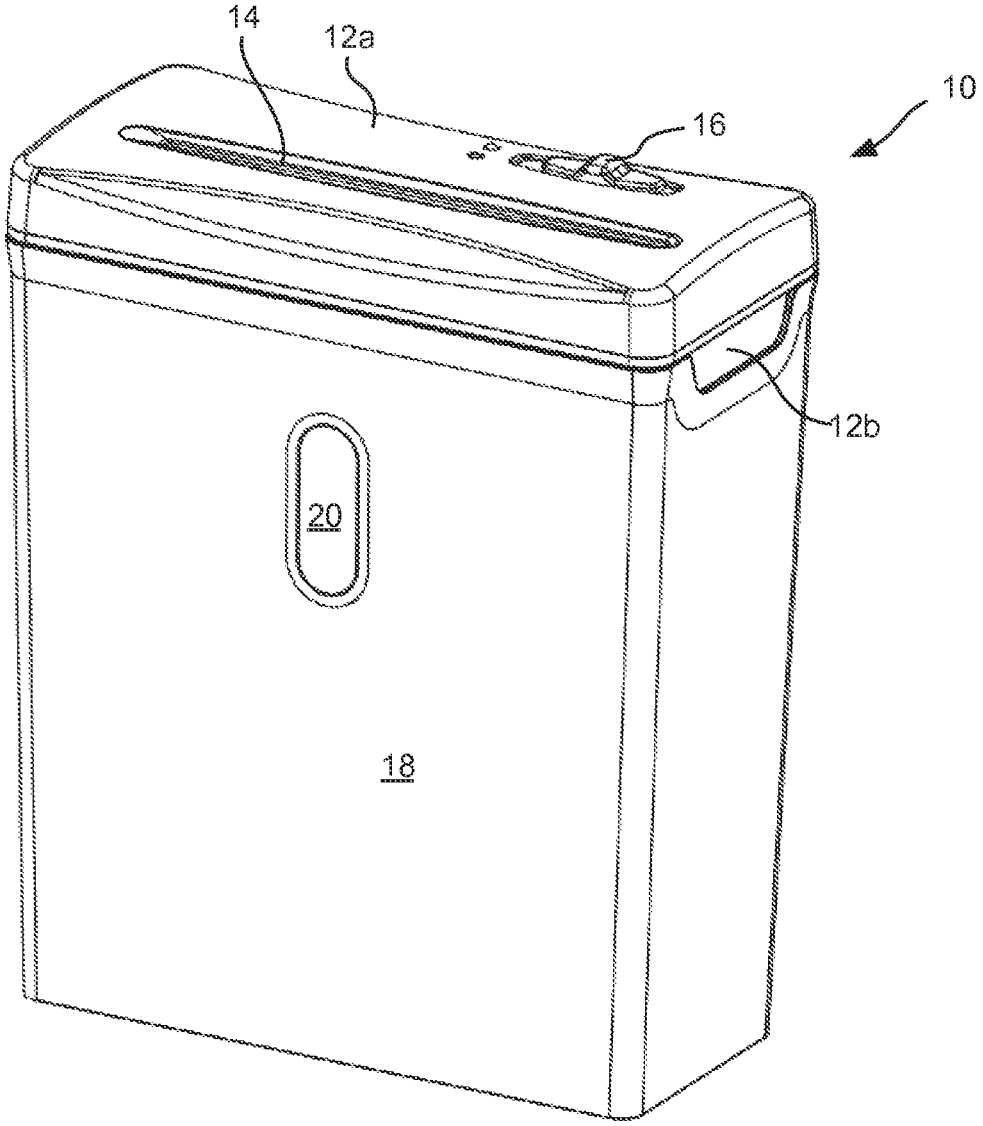
FIG. 1 illustrates an isometric view of a document shredder.

FIG. 1 illustrates an isometric view of a document shredder 10. The document shredder 10 may include a housing formed of one or more housing portions 12*a*, 12*b*, such as an upper housing portion 12*a* and a lower housing portion 12*b*. The housing portion 12*a* may define a slot 14 for receiving sheets of papers or other shreddable items. One of the housing portions 12*a*, 12*b* may also have one or more controls 16 mounted thereto, such as an on/off switch, direction selector, and the like. The housing portions 12*a*, 12*b* may be sized and configured to rest on a basket 18 that may be sized to conform to the housing portions 12*a*, 12*b* or a general use receptacle on which the housing portions 12*a*, 12*b* may rest. In the illustrated embodiment, the basket 18 defines a window 20, enabling a user to determine an amount of shredded material in the basket 18.

Figure 2:
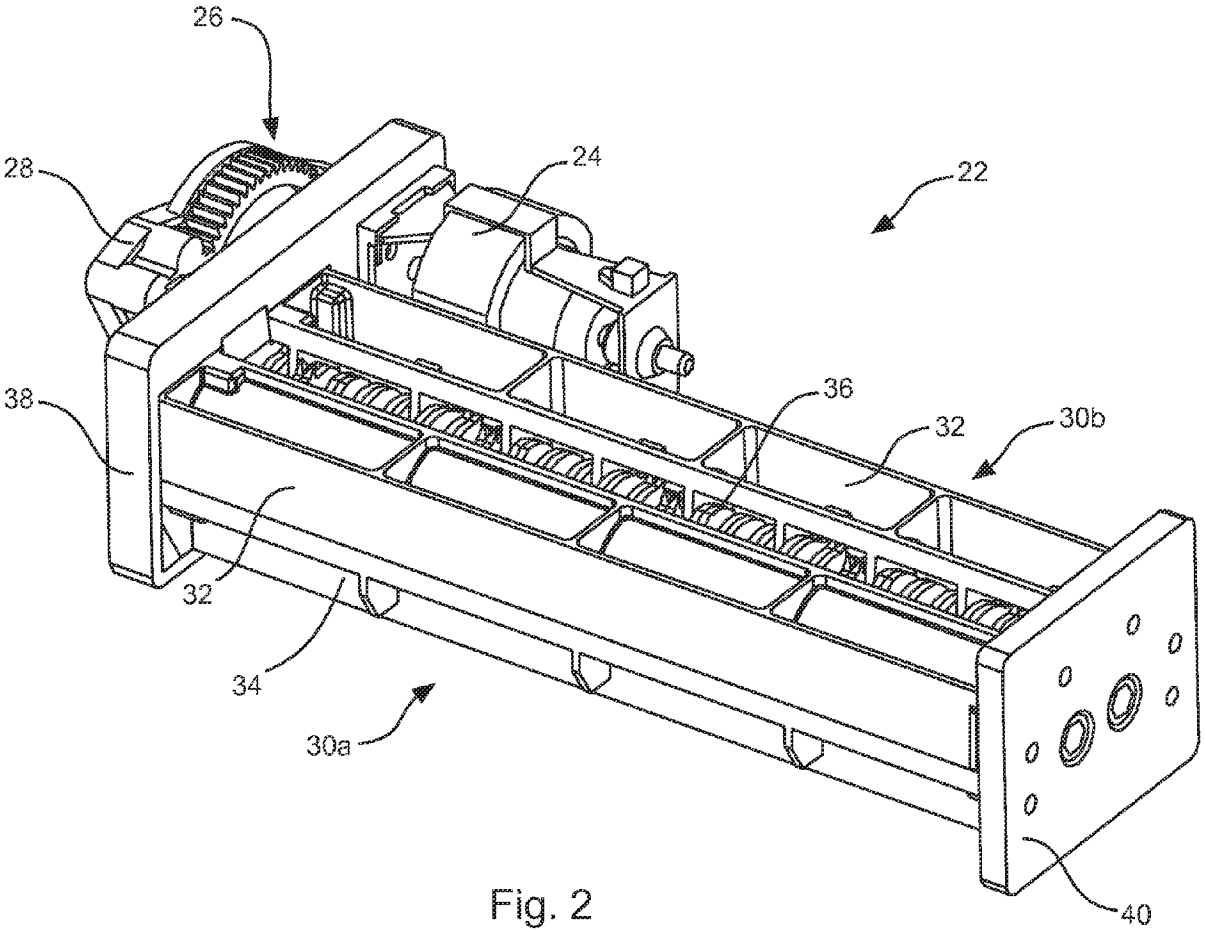
FIG. 2 illustrates an isometric view of a shredder mechanism of the document shredder.

FIG. 2 illustrates an isometric view of a shredder mechanism 22. The shredder mechanism 22 is positioned within a housing, such as a housing defined by housing portions 12*a*, 12*b* of FIG. 1. The shredder mechanism 22 includes a motor 24 for driving the shredder. The motor 24 may be coupled to a gear assembly 26 that may be positioned within a gear housing 28. The motor 24, gear assembly 26, and gear housing 28 may be configured according to any configuration of such elements known in the art.

The shredder mechanism 22 may include shaft support assemblies 30*a*, 30*b*. The shaft support assemblies 30*a*, 30*b* may be identical, mirror images of one another, or both shaft support assemblies 30*a*, 30*b* may at least include the features disclosed herein but have other features that are not common to both shaft support assemblies 30*a*, 30*b*. As illustrated, the shaft support assemblies 30*a*, 30*b* have their longitudinal axes parallel to one another. The shaft support assemblies

30*a*, 30*b* define a slot therebetween that may be aligned with the slot 14 defined by the housing portion 12*a*.

In the illustrated embodiment, the shaft support assemblies 30*a*, 30*b* include upper supports 32 and lower supports 34. As will be described in greater detail below, the shaft support assemblies 30*a*, 30*b* support shafts to which cutting blades 36 are secured. The cutting blades 36 extend into the slot defined by the shaft support assemblies 30*a*, 30*b* in order to cut paper within the slot as known in the art. In the illustrated embodiment, the shaft support assemblies 30*a*, 30*b* are secured at the ends thereof to plates 38 and 40. In the illustrated embodiment, the motor 34, gear assembly 26, and gear housing 28 are secured to the plate 38.

Figure 3:
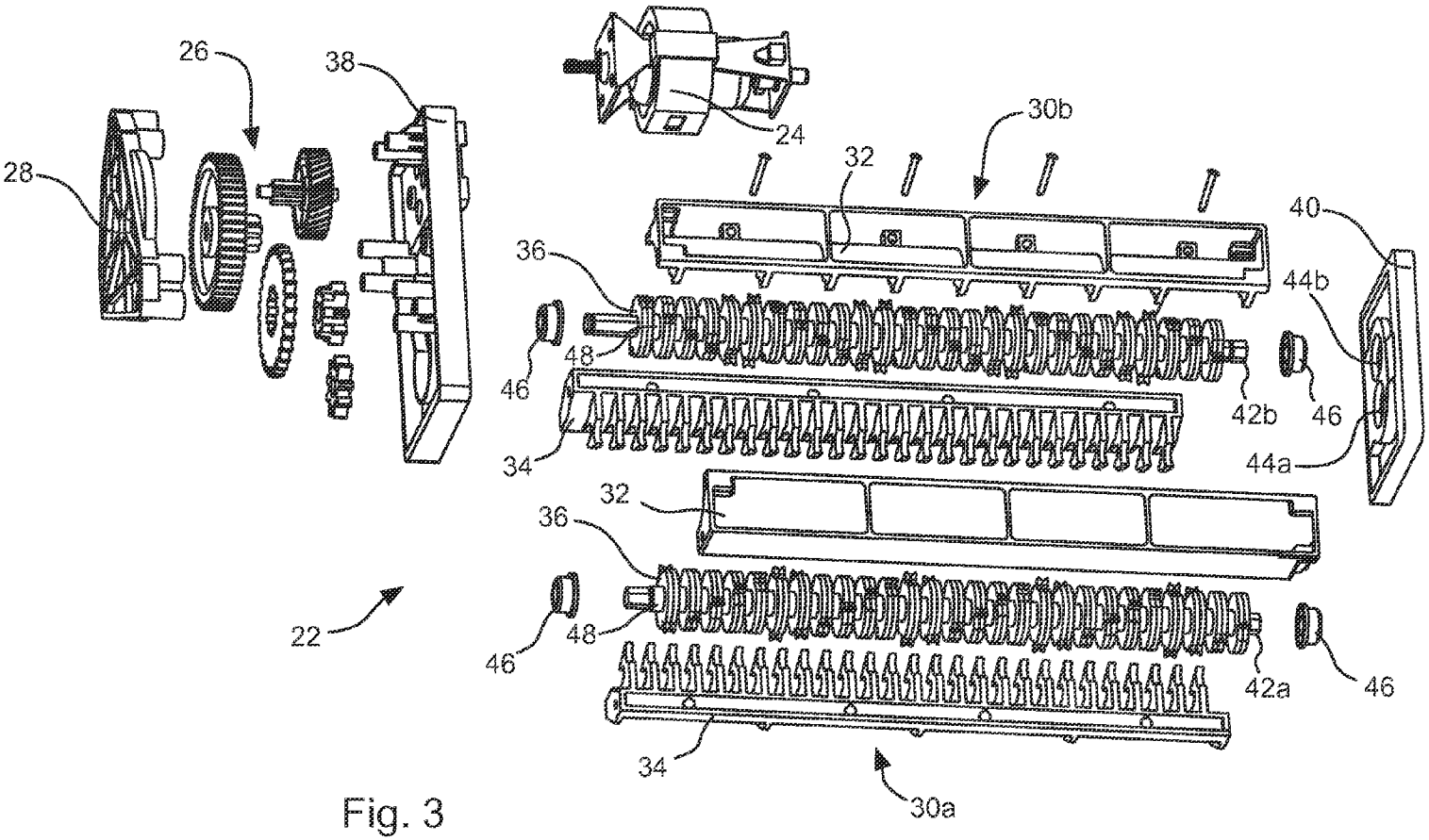
FIG. 3 illustrates an exploded isometric view of the shredder mechanism.

FIG. 3 is an exploded view of the shredder mechanism 22. The blades 36 may be mounted to shafts 42*a*, 42*b* that are supported by the shaft support assemblies 30*a*, 30*b*, respectively. The shafts 42*a*, 42*b* may also be supported at ends thereof within apertures 44*a*, 44*b* defined in the end plates 38, 40. Rotation of the shafts 42*a*, 42*b* within the apertures 44*a*, 44*b* may be facilitated by means of bearings 46, such as plastic bearings, interposed between the shafts 42*a*, 42*b* and the apertures 44*a*, 44*b*. As illustrated, the shafts 42*a*, 42*b* may have one or more non-rounded end portions, e.g. square, hexagonal, or some other shape, to facilitate driving of the shafts 42*a*, 42*b* by means of the gear assembly 26. The shafts 42*a*, 42*b* may include a rounded portion 48 extending between the blades 36 and/or outwardly from an end-most blade 36. The rounded portion 48 may be formed by an outer surface of the shaft 42*a*, 42*b* itself, by a sleeve forming an outer surface of the shaft 42*a*, 42*b*, or by sleeve portions secured to each blade 36 and defining an outer surface of the shaft 42*a*, 42*b*. The configuration of the shafts 42*a*, 42*b* and blades 36 is exemplary only. Any shaft and blade assembly known in the art may advantageously be used in accordance with the embodiments disclosed herein.

Figure 4:
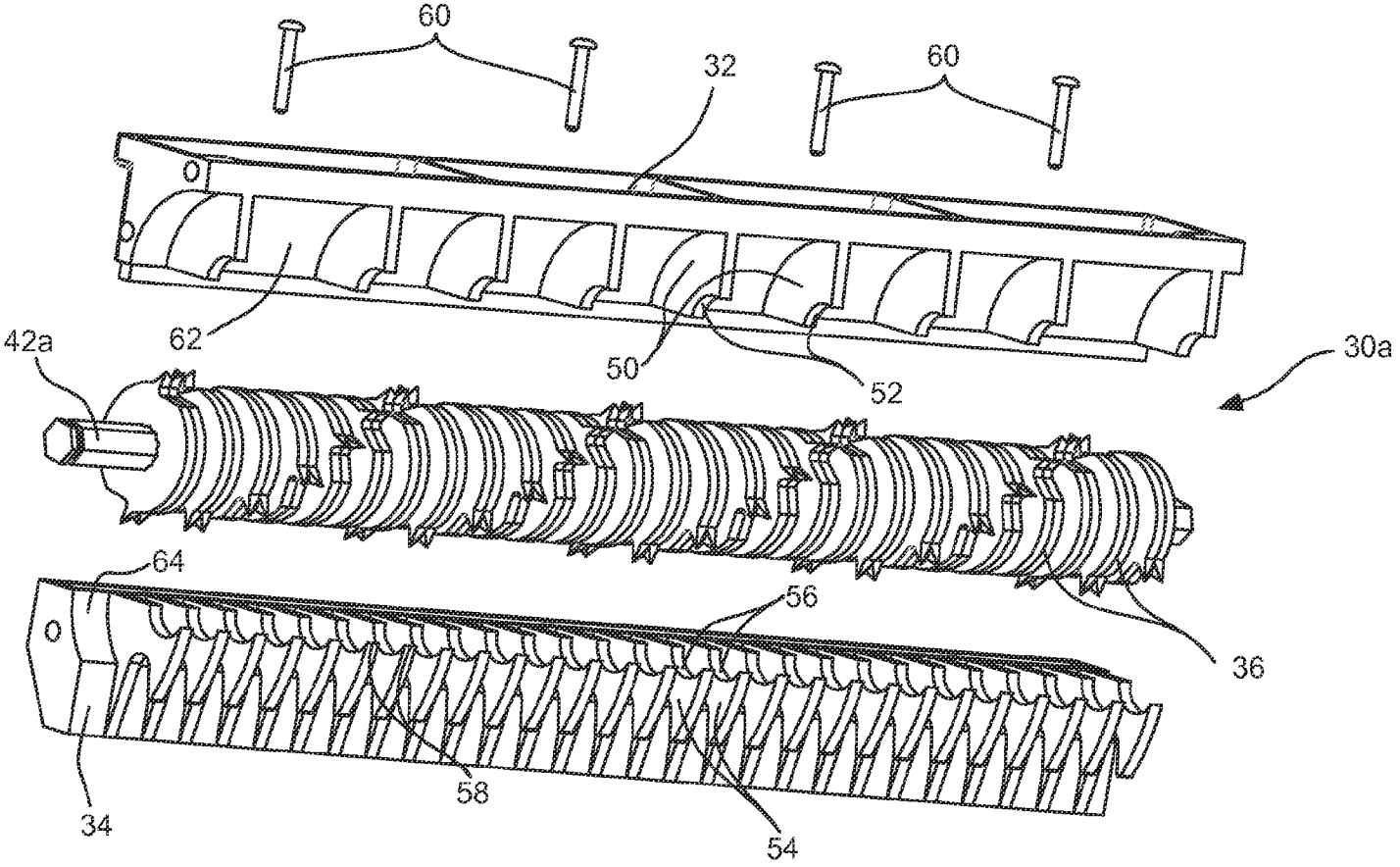
FIG. 4 illustrates an exploded isometric view a shaft support assembly.

FIG. 4 illustrates an exemplary shaft support assembly 30*a*. The shaft support assembly 30*b* may include the same features, such as in a mirrored configuration. The upper support 32 may include upper fins 50 sized and longitudinally distributed to fit between adjacent blades 36 and substantially occupy the gap between adjacent blades 36. For example, the upper fins 50 may have a width such that they may slide without resistance between adjacent blades 36. For example, in some embodiments, the upper fins 50 have a width of between 2 and 4 mm. The upper fins 50 may define shaft receptacles 52 sized to engage the shaft 42*a*. For example, the shaft receptacle 52 may have an arcuate shape having a radius of curvature sized to conform to the shaft 42*a*, such as a rounded portion 48 (see FIG. 3) of the shaft 42*a*. For example, the radius of curvature of the shaft receptacle 52 may be slightly larger than the portion of the shaft 42*a* engaged therewith such that the shaft 42*a* can rotate. However, the radius of curvature of the shaft receptacle 52 may be sized such that the shaft receptacle 52 can resist deflection of the shaft 42*a*, such as deflection due to forces exerted on the shaft by the blades 36 when shredding material. Accordingly, a radius of curvature of the receptacle 52 may be equal to the outermost diameter of the shaft 42*a* engaged with the receptacle 52, such as the rounded portion 48, plus a maximum permissible deflection for the shaft 42*a*. For example, a maximum permissible deflection may be equal to 1% of a length of the shaft 42*a*, preferably less than 0.1% of the length of the shaft 42*a*, and more preferably less than 0.01% of the length of the shaft 42*a*. In still other embodiments, the maximum permissible displacement is less than or equal to 0.4 mm.

The lower support 34 may define lower fins 54 each defining shaft receptacles 56. The width of the lower fins 54 and radius of curvature of the receptacles 56 may be determined as described above with respect to the upper fins 50 and shaft receptacles 52, respectively. In addition to supporting the shaft 42*a*, the lower fins 54 may operate as strippers for removing shredded material from between the blades 36. Accordingly, the lower fins 54 may define a stripper edges 58 that are positioned adjacent the shaft 42*a* when assembled and operable to scrape material from the shaft 42*a*.

As is apparent in FIG. 4, some embodiments include a fewer number of upper fins 50 than lower fins 54. For example, a number of the lower fins 54 may be from one to four, preferably two to four, times greater than a number of the upper fins 50. In the illustrated embodiment, there are three times as many lower fins 54 as upper fins 50. For example, the number of lower fins 54 may be equal to the number of gaps between adjacent blades, e.g. N−1 lower fins 54 for embodiments including N blades 36. In this manner, the lower fins 54 can operate as strippers between blades. The upper fins 50 may not be located within each gap between adjacent blades inasmuch as they are not useful for paper stripping and a smaller number of upper fins 50 may provide adequate support. Accordingly, one or more upper fins 50 may be used having at least one of the upper fins 50 spaced apart from the ends of the upper support 32 such that a middle portion of the shaft 42*a* is supported against impermissible deflection. For example, at least one upper fin 50 may be separated from both ends of the upper support 32 by a distance greater than 10% of a length of the upper support 32, preferably greater than 20%, and more preferably greater than 40%.

In some embodiments, the spacing between the upper fins 50 may be non-uniform. For example, the spacing between the outermost upper fins 50 and the inwardly positioned upper fins 50 closest to the outermost upper fins 50 may be unequal to, e.g. greater than, a spacing between the inwardly positioned upper fins 50. For example, a distance between an outermost upper fin 50 and the closest inwardly positioned upper fin 50 may be 32.64 mm and the spacing between adjacent inwardly positioned upper fins 50 may be 24.48 mm. The spacing between upper fins 50 described above may refer to a distance between centers of adjacent upper fins 50, faces of adjacent upper fins 50 facing in the same direction, or a separation between surfaces of adjacent upper fins 50 facing one another.

The shaft receptacles 52 and shaft receptacles 56 may cooperate to capture the shaft 42*a*. For example, the upper support 32 may secure to the lower support 34, such as by means of fasteners 60, such as screws, bolts, rivets, or some other fastening means. When the upper support 32 is secured to the lower support 34, the shaft receptacles 52 and shaft receptacles 56 may encircle more than 50% (e.g. more than 180°) of a circumference of the shaft 42*a*, preferably more than 60% (e.g. more than 216°) of the circumference of the shaft 42*a*. In the illustrated embodiment, the shaft receptacles 52, 56 encircle about 75% (e.g. 270°) of the circumference of the shaft 42*a*. In general, the shaft receptacles 56 may be positioned below the shaft 42*a* when assembled and the shaft receptacles 52 may be positioned above the shaft 42*a*.

When the upper and lower supports 32, 34 are secured to one another, each of the upper fins 50 may be aligned with an opposing lower fin 54. An upper fin 50 and corresponding opposing lower fin 54 may be considered as a single support fin providing additional support relative to lower fins 54 without an opposing upper fin 50. Although the illustrated embodiment shows upper fins 50 secured to an upper support 32 and lower fins 54 secured to a lower support 32, in some embodiments, a support assembly may include support fins embodied as a single member and secured to a support assembly that includes upper and lower supports 32, 34 implemented as a single monolithic member or separate members.

In some embodiments, the upper support 32 and upper fins 50 may be formed as a single monolithic member, such as a die-cast metal member. Likewise, lower support 34 and lower fins 54 may also be formed as a single monolithic member, such as a die-cast metal member. Alternatively, upper fins 50 and lower fins 54 may secure to the upper and lower supports 32, 34, respectively, by means of welds or some other fastening means.

In prior devices, lower fins 54 made of a plastic material were used to operate as strippers, but did not provide significant support. In some embodiments of the invention, support fins (e.g. an upper fin 50 and opposing lower fin 54) are made of metal, such as by monolithic die-cast fabrication, whereas lower fins 54 that are not aligned with a corresponding upper fin 50 may still be made of plastic or some other material that does not provide significant support to the shaft 42*a*. In still other embodiments, upper fins 50 are made of metal and lower fins 54 are made of plastic.

The upper support 32 may define a concave surface 62, such as a partial cylindrical surface, sized to receive the blades 36. Likewise, the lower support 34 may define a concave surface 64 sized to receive the blades 36. The concave surfaces 62, 64 may be concentric with the shaft receptacles 52, 56, respectively. A radius of curvature of the concave surfaces 62, 64 may be larger than an outermost diameter of the blades 36.

Figure 5:
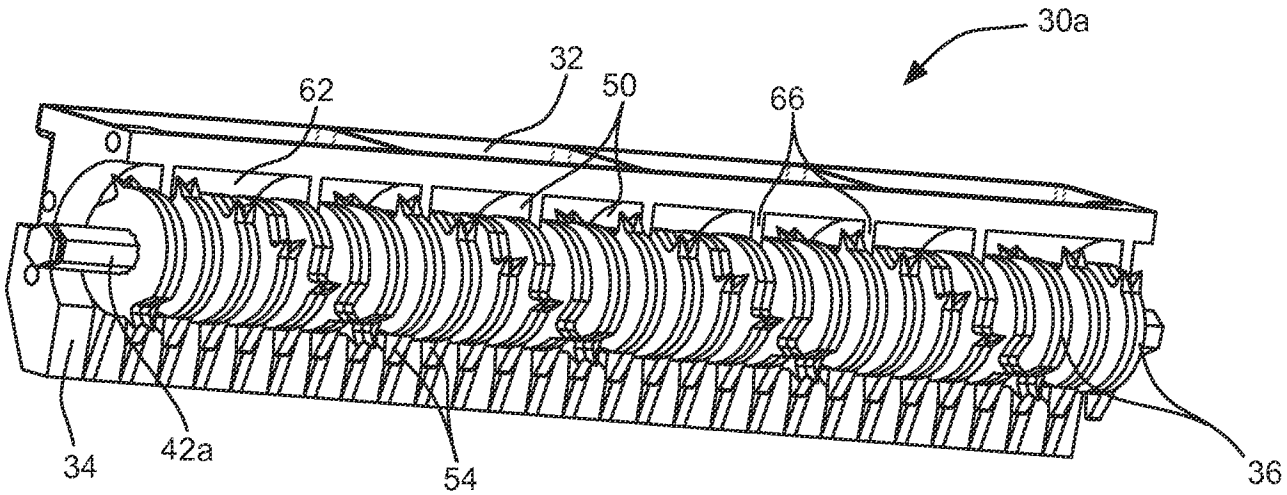
FIG. 5 illustrates an isometric view of an assembled shaft support assembly.

FIG. 5 illustrates the support assembly 30*a* having the upper support 32 secured to the lower support 34 and the shaft 42*a* and corresponding blades 36 captured between the upper support 32 and the lower support 34. As illustrated, the upper fins 50 and lower fins 54 are inserted among the blades 36 and the blades 36 also extend outwardly from the supports 32, 34 such that they are extend into a slot between the support assemblies 30*a*, 30*b* when assembled. In some embodiments, outer faces 66 of the upper fins 50 may operate as guides that urge sheets of material to remain flat and upright within the slot defined by the support assemblies 30*a*, 30*b*.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A shredder comprising:

a shredder housing;

first and second shredder portions positioned within the housing opposite one another and defining a slot therebetween in a vertical direction, the first and second shredder portions each including a longitudinal support, a plurality of support fins secured to the longitudinal support and defining a plurality of shaft support receptacles, a shaft positioned within the plurality of shaft support receptacles, the plurality of shaft support receptacles encircling the shaft both above and below the shaft along the vertical direction, the plurality of support fins hindering deflection of the shaft, and a plurality of cutting blades mounted to the shaft and extending into the slot, each of the plurality of support fins extending among the plurality of cutting blades; and a motor coupled to the shafts of the first and second shredder portions;

wherein a number of the plurality of support fins is less than a number of the plurality of stripper fins.

2. The shredder of claim 1, wherein the first and second shredder portions further comprise a plurality of stripper fins mounted to the longitudinal support interleaved with the support fins, the plurality of stripper fins extending among the plurality of cutting blades and defining a plurality of stripper receptacles having the shaft positioned therein.

3. The shredder of claim 2, wherein the stripper receptacles encircle a smaller circumferential portion of the shaft than the shaft support receptacles and are positioned beneath the shaft.

4. The shredder blade assembly of claim 2, wherein the longitudinal support comprises an upper support portion and a lower support portion, the plurality of stripper fins being secured to the lower support portion.

5. The shredder of claim 4, wherein the plurality of support fins include upper fin portions secured to the upper support portion and lower fin portions secured to the lower support portion, the shaft being captured between the upper and lower fin portions.

* * * * *